United States Patent [19]

Kemeny

[11] Patent Number: 4,961,366

[45] Date of Patent: Oct. 9, 1990

[54] ELECTROMAGNETIC LAUNCHER APPARATUS FOR REDUCING BORE RESTRIKE DURING A PROJECTILE LAUNCH

[75] Inventor: George A. Kemeny, Wilkins Township, Allegheny County, Pa.

[73] Assignee: Westinghouse Electric Corp., Pittsburgh, Pa.

[21] Appl. No.: 161,537

[22] Filed: Feb. 29, 1988

[51] Int. Cl.[5] ..... F41F 1/02

[52] U.S. Cl. ..... 89/8; 124/3

[58] Field of Search ..... 89/8; 124/3; 310/11, 310/12

[56] References Cited

U.S. PATENT DOCUMENTS 4,343,223 8/1982 Hawke et al. ..... 89/8

4,796,511 1/1989 Eyssa ..... 89/8

OTHER PUBLICATIONS

Mannix et al., Proceedings of the Second Hypervelocity and Impact Effects Symposium, vol. I, Dec. 1957, pp. 133–134.

*Primary Examiner*—Stephen C. Bentley

*Attorney, Agent, or Firm*—D. Schron

[57] ABSTRACT

An electromagnetic launcher having parallel rails bridged by a projectile driving armature. Another set of rails, acting as current feed rails, delivers current, from an energy source, to the projectile rails at the far or muzzle end thereof as opposed to the breech end, as is done in conventional electromagnetic launchers.

10 Claims, 2 Drawing Sheets

POWER SUPPLY
10
11
12
13
16
19
20
30
31
32
33
36
37
40
41
44
46
48
50
52
53
56
P
F
A
B
C
D

ELECTROMAGNETIC LAUNCHER APPARATUS FOR REDUCING BORE RESTRIKE DURING A PROJECTILE LAUNCH

BACKGROUND OF THE INVENTION

1. Field of the Invention

The invention in general relates to electromagnetic launcher systems, and particularly to an arrangement which reduces the likelihood of undesired parasitic arcing between the launch rails when a projectile is fired.

2. Description of the Prior Art

One type of electromagnetic launcher basically consists of a power supply and two generally parallel electrically conducting rails between which is positioned an electrically conducting armature. Current from the power supply flows down one rail, through the armature and back along the other rail whereby a force is exerted on the armature to accelerate it, and a payload, along the rails so as to attain a desired muzzle or exit velocity. Current conduction between the parallel rails may be accomplished by a solid metallic or metal fiber armature or by an armature in the form of a plasma or arc which creates an accelerating force on the rear of a sabot which in the bore length supports and accelerates the projectile.

When a conventional parallel rail electromagnetic launcher is operated at high currents and high projectile velocities, a high voltage is generated across the rails in the wake of the projectile. This high voltage may cause a parasitic voltage breakdown well behind the projectile forming a parallel path for the high current with a resultant very significant deleterious reduction of the projectile accelerating force. This voltage breakdown is especially pronounced in plasma driven systems because of the presence of hot gas and plasma remaining between the rails in the wake of the projectile, and because the inter-rail insulation has been heated by the plasma which facilitates insulation surface breakdown.

The present invention provides for a radically new design in an electromagnetic launcher which substantially reduces or for certain conditions eliminates the chances of parasitic voltage breakdown between the rails.

SUMMARY OF THE INVENTION

Electromagnetic launcher apparatus in accordance with the present invention includes a pair of generally parallel electrically conducting projectile rails having a breech end and a muzzle end. In addition to the projectile rails, there are provided first and second electrically conducting feed rails each being positioned adjacent a respective one of the projectile rails and in substantial flux linking relationship with its adjacent rail. The first and second feed rails are electrically connected to a respective one of the projectile rails at the far, or muzzle end thereof. An energy source is connected to the feed rails to supply a high current thereto, and which current flows into the projectile rails and traverses an armature, either metallic or plasma, extending between the rails so as to accelerate a projectile along the rails from the breech end to the muzzle end.

DESCRIPTION OF THE PREFERRED EMBODIMENT

Figures 1, 2, 3:
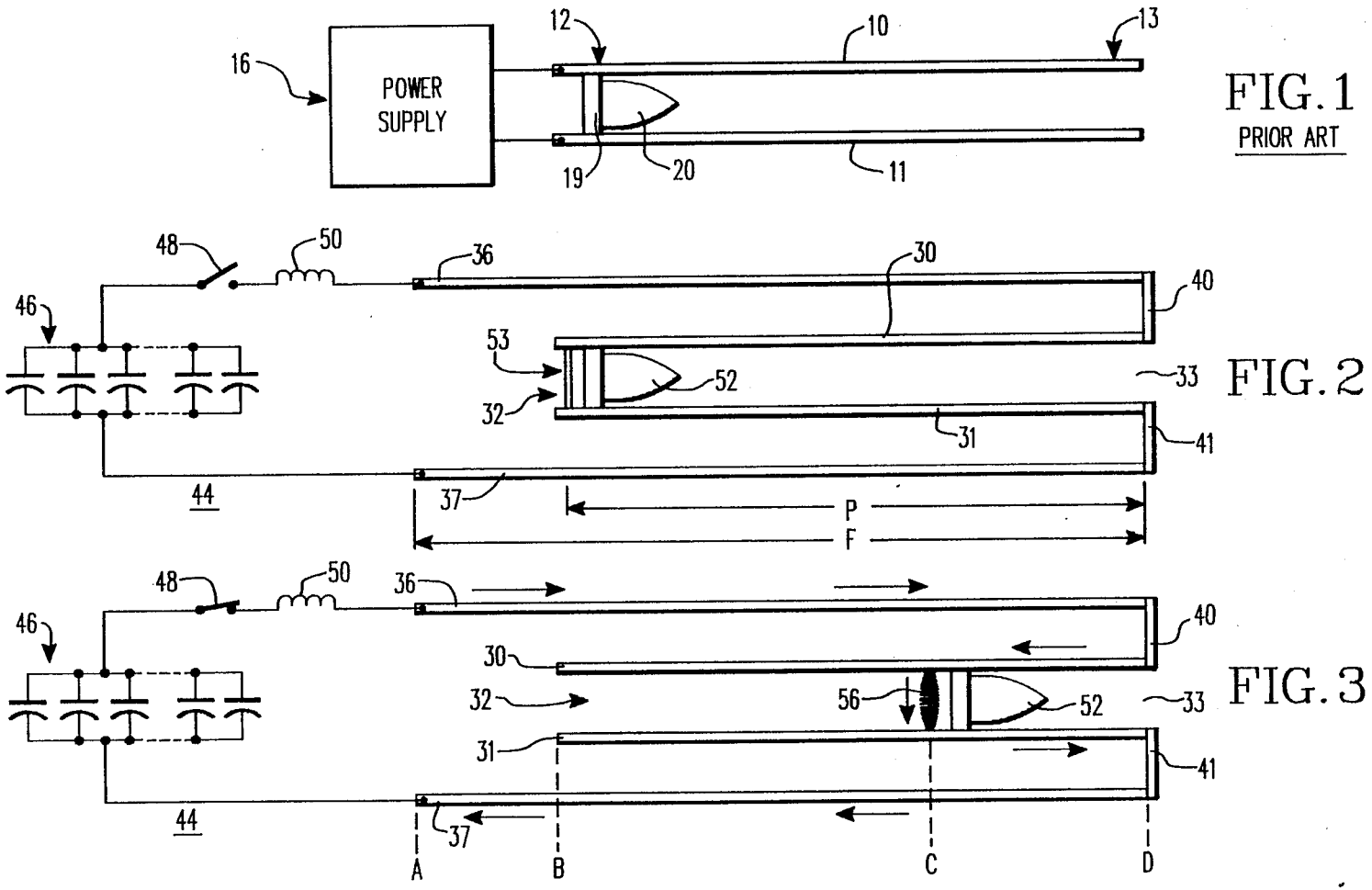
FIG. 1 PRIOR ART
FIG. 1 is a simplified version of one type of electromagnetic launcher.
FIG. 2 illustrates one embodiment of the present invention.
FIG. 3 illustrates a projectile during a launch sequence.

One common type of prior art electromagnetic launcher, as depicted in FIG. 1, includes a rail system comprised of electrically conducting, generally parallel rail members 10 and 11 having a breech end 12 and a muzzle end 13.

The rails, at the breech end 12, are connected to an energy source in the form of power supply 16 operable to supply a high current, often measurable in millions of amperes. The rails are bridged by an electrically conducting armature 19 for propelling a projectile 20 along the bore length of the rails from the breech end 12 towards the muzzle end 13. During the launching, high current is supplied and flows down one rail, through the armature 19 and back along the other rail such that the current flowing in the loop exerts a force on the armature 19 to accelerate and launch the projectile 20.

The accelerating force, in essence, is a function of the magnetic flux density and current density vectors, in the vicinity of the armature, and since the current flowing in the rails is often measured in millions of amperes, projectile 20 exits the muzzle end 13 of the rail system at exceptionally high velocities measurable in kilometers per second.

Systems which utilize a plasma armature are particularly susceptible to parasitic voltage breakdown across the rails, well behind the projectile, which forms a parallel current path which has the effect of substantially reducing the current being supplied to the driving plasma armature. Under such circumstances, the accelerating force on the projectile is greatly reduced, and the effect of, which severely degrades the electromagnetic launcher performance.

In a conventional launcher such as illustrated in FIG. 1, the maximum voltage across the rails during projectile acceleration occurs at the breech end, and this voltage is substantially equal to:

$$V = iR'x + \frac{d}{dt}(L'xi) \tag{1}$$

where i is the instantaneous current,

R= is the effective ohmic rail resistance per unit length, x is the traversed bore length, L= is the bore inductance gradient.

Equation (1) may be expressed as follows:

$$V = iR'x + xL'\frac{di}{dt} + iL'\frac{dx}{dt} \tag{2}$$

Basically, the higher the breech voltage V the greater the likelihood of a parasitic breakdown across the rails, and particularly so in a high velocity plasma armature driven system.

In such systems, as the projectile traverses the bore, the rail current generally decreases. Accordingly, the expression di/dt of Equation (2) is negative making the middle term of the equation negative and beneficially lowering the magnitude of the across-the-rail voltage V. If however the absolute value of di/dt is increased in order to decrease the magnitude of V and the likelihood of a bore restrike, the increase would require faster current attenuation resulting in a more rapid reduction of the projectile accelerating force, which would be highly counterproductive.

The last term in Equation (2) represents the back EMF which is produced as the projectile is fired and is a function of projectile velocity v, that is, $v=dx/dt$. The first term of Equation (2), $iR=x$, represents the longitudinal rail pair ohmic voltage drop which, for a typical high velocity electromagnetic launcher, may be in the order of 2 to 4 kilovolts when the projectile approaches the muzzle. This magnitude is sufficient to substantially increase the likelihood of parasitic arcing across the rails in the wake of the projectile and if this ohmic rail voltage drop could be eliminated, then higher projectile velocities could be reliably and consistently attained because the likelihood of parasitic arcing would be significantly reduced. The present invention, one embodiment which is illustrated in FIG. 2, totally eliminates this objectionable ohmic rail voltage drop to therefore reduce or for particular scenarios completely eliminate the likelihood of restrikes in the wake of the projectile.

The electromagnetic launcher of FIG. 2 includes a pair of generally parallel electrically conducting projectile rails 30 and 31 having a breech end 32 and a muzzle end 33. In addition, first and second electrically conducting feed rails 36 and 37 are provided with each being positioned adjacent a respective one of the projectile rails 30 and 31 in a manner to be in substantial flux linking relationship with its adjacent rail. Feed rails 36 and 37 are respectively connected to adjacent projectile rails 30 and 31 at the muzzle end 33 by means of respective electrical connections 40 and 41.

An energy source 44 is connected to feed rails 36 and 37 and includes storage means in the form of a capacitor bank 46 which supplies high current to the feed rails 36 and 37 when switch 48 is closed. In order to limit the surge of current to some maximum value, a current controlling inductor 50 may be placed in the power supply circuitry. Crowbarring circuitry (not shown) may additionally be supplied for each capacitor, for groups of capacitors, or the whole capacitor bank.

Located between the projectile rails 30 and 31 is a sabot held projectile 52 behind which is a starting wire or fuse 53. When switch 48 is closed, a large current flows down the rails and through fuse 53 causing it to explode thereby striking or initiating the arc or plasma which drives the sabot and projectile 52 along the projectile rails. Alternatively, the voltage breakdown or arcing behind the sabot to start the current flow may be initiated by the timely injection of ionized fluid, or by an electron or laser beam which sufficiently lowers the resistance to voltage breakdown. The active current carrying length of the feed rails 36 and 37 is always the length F and the active current carrying length of the projectile rails 30 and 31 at the instant of firing is P, where $F>P$. The self inductance per unit length of the projectile rail pair 30 and 31 is $L_{=P}$ and the self inductance per unit length of the feed rail pair 36 and 37 is $L_{=F}$. The coupling coefficient between adjacent rail pairs 30, 31 and 36, 37 is k. Let it be assumed that $L_{=P}=L_{=F}=L_{=}$ and with such assumption the accelerating force F, to a good approximation, will be:

$$F = \tfrac{1}{2}\, i^2 L'(2k-1) \qquad (3)$$

In the ideal case, if k is unity then there would be no flux field inbetween projectile rails 30 and 31 ahead of the projectile 52. Since $F>P$, there will be a flux field behind the projectile 52 and the driving force will approach that of a conventional electromagnetic launcher such as illustrated in FIG. 1, as k approaches unity.

FIG. 3 illustrates the projectile during a launch and being driven by an established plasma 56; current flow through the rails and plasma is as indicated by the arrows. The distance between the opposite ends of the feed rails 36 and 37 is given by AD and the distance between the opposite ends of the projectile rails 30 and 31 is given by BD. The present position of the projectile, more particularly current carrying arc 56, is at C.

In the wake of the projectile between rails 30 and 31 from B to C there is no current flow and therefore the ohmic voltage drop $iR=x$ (see Equations 1 and 2) is eliminated. As a projectile travels down the bore length at a velocity v, there is induced across the already traversed projectile rails a back $EMF=iL_{=}(2k-1)v$. If k is unity, this voltage is the back EMF of a conventional electromagnetic launcher illustrated in FIG. 1 and accordingly the back EMF contribution to the breech rail voltage can only approach, and not exceed the value of the third term of Equation (2).

Accordingly, the likelihood of parasitic restrikes in the already traversed bore from B to C will be significantly reduced because of the elimination of the ohmic voltage drop contribution to the across-the-rail voltage. If the velocity of the projectile is exceptionally high as it is near the muzzle end of the rails, the back EMF may increase to a point where it may by itself cause a parasitic bore restrike. However, at the instant of possible restrike across the projectile rails there is no current in the projectile rail segment from B to C and because such segment would have a rather high inductance, any parasitic current rise will be relatively slow and the projectile in all probability will have exited before parasitic current flow is sufficient to measurably reduce muzzle velocity.

Since current is flowing in the projectile rails 30 and 31 ahead of projectile 52, across-the-rail voltages will exist in the region from C to D which however are very unlikely to generate precursor or forerunner parasitic arcs. In addition to the relatively small voltage drop across the driving plasma, there is this additional ohmic voltage drop measured at the muzzle end 33, and this voltage is a function of the current from D to C, the effective ohmic rail pair resistance per unit bore length and the distance from D to C (similar to the first term of Equation 2 for a conventional electromagnetic launcher arrangement). This ohmic voltage drop is at its maximum when the projectile is at position B or is still moving relatively slowly and when precursor arcing is extremely unlikely. As C approaches D, the magnitude of this ohmic across-the-rails voltage continually decreases.

If the coupling coefficient k between adjacent rails is close to, but is not unity, a low flux density field will exist between projectile rails 30 and 31 ahead of the projectile. As C approaches D, the net flux in the as yet untraversed bore length decreases, with this reduction producing an EMF which is opposite to the ohmic voltage across the rails and therefore contributes to a net reduction in the overall across-the-rails voltage thus further reducing the likelihood of precursor arcing.

In an electromagnetic launcher having parallel rails fed by an energy source, as the projectile exits from the rails, a relatively high magnitude of inductive energy remains in the rail system to be either dissipated or to be recovered for use in a subsequent launch. In a conventional electromagnetic launcher such as illustrated in FIG. 1, current continues to flow in the projectile rails until the dissipation or recovery process is completed. Since the current and energy dissipation or recovery process will take far more time than just the projectile acceleration, the projectile rails are subject to objectionable heating due to the post launching current which may alter the projectile rail characteristics to an extent where launch performance is degraded.

With the present invention, however, post-launch current flow due to inductive storage is confined to the feed rails 36, 37 only, as opposed to the projectile rails 30, 31. The energy may be recovered in a number of ways, one of which would be by shorting across the muzzle 33 after projectile exit which can then result in inductive feed rail energy being oscillated back to the capacitor bank 46 and to be retained there by opening the shorting switch at the current zero.

Therefore with the present arrangement, such as illustrated in FIG. 3, the projectile rails 30, 31 are subjected to much less rail heating than in the conventional electromagnetic launcher configurations.

Figure 4:
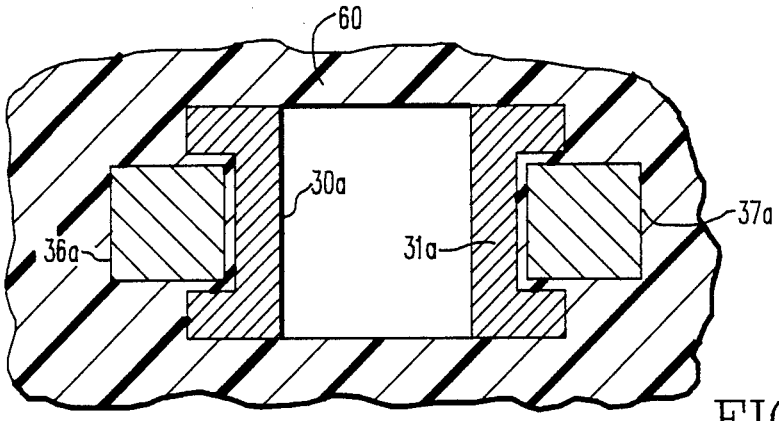
FIG. 4 is a sectional view of one embodiment of feed and projectile rails.

With respect to the relationship between rail current i and accelerating force F, Equation (3) was simplified with the assumption that the inductance gradient of the feed rails $L_{=F}$ and projectile rails $L_{=P}$ are each equal to $L_{=}$. Based upon this simplifying assumption, the accelerating force of the launcher arrangement of the present invention can only approach, but not exceed the accelerating force associated with the conventional launcher. The accelerating force with the present invention may be increased by means of proper selection of rail geometry wherein the self inductance gradients of the feed and projectile rails are not equal. One such rail arrangement is illustrated in FIG. 4 which is a sectional view through the rails looking along the bore axis. The projectile rails are designated 30*a* and 31*a* and the feed rails 36*a* and 37*a*. The rail system is surrounded by a rigid insulating restraining structure, a portion of which 60, is illustrated.

In the embodiment of FIG. 4, $L_{=F} > L_{=P}$ by some factor A. That is:

$$L_{=F} = AL_{=P} \tag{4}$$

The accelerating force equation then becomes:

$$F = \tfrac{1}{2} i^2 L'_P (2k\sqrt{A} - 1) \tag{5}$$

By way of example, with respect to Equation (5), if k were equal to 0.85 and A to 1.5 the net force would then be about 8% above that of a conventional electromagnetic launcher with a projectile rail inductance gradient of $L_{=P}$.

Figure 5:
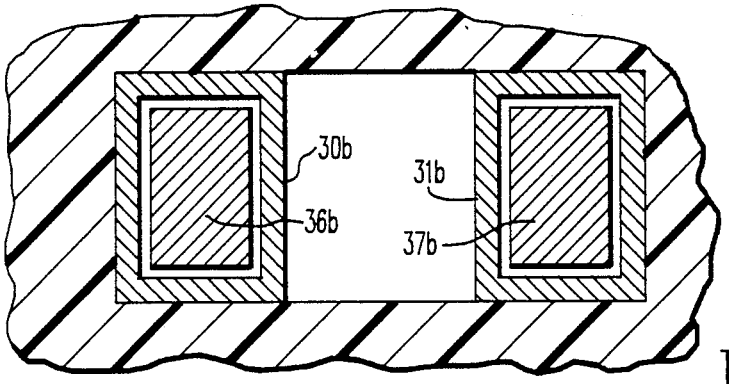
FIG. 5 is a sectional view of another embodiment of feed and projectile rails.

In the embodiment of FIG. 4, the projectile rails 30*a* and 31*a* partially surround respective feed rails 36*a* and 37*a*. In the embodiment of FIG. 5, the projectile rails 30*b* and 31*b* are concentrically disposed about respective feed rails 36*b* and 37*b* in which case the coupling coefficient k can be very close to unity.

In the conventional plasma armature electromagnetic launcher, at high projectile velocities, the projectile rail current just in the wake of the projectile is known to be concentrated in a very thin surface layer on the inside rail faces. This current concentration results in a higher rail ohmic resistance and therefore, more rail surface heating thereby resulting in more rail damage and wear. Conversely with the arrangement of the present invention, the accelerating current successively abandons the rail in the wake of the projectile which is expected to result in far less current concentration effects and may thereby prolong rail surface life.

Figure 6:
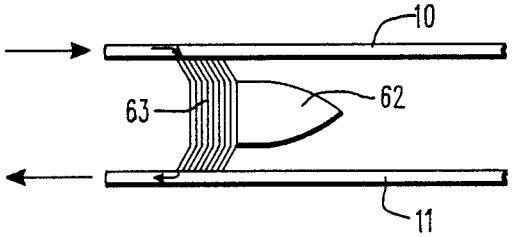
FIG. 6 PRIOR ART
FIG. 6 illustrates current flow through a metallic armature in a conventional electromagnetic launcher.
Figure 7:
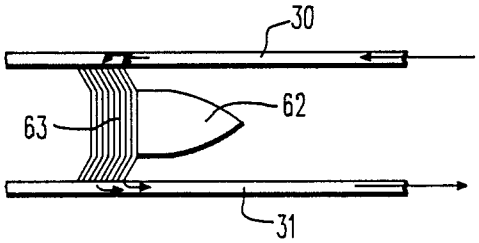
FIG. 7 illustrates current flow to a metallic armature with the present arrangement.

Rail surface damage is also very likely to be reduced with a conventional metallic armature such as those having a chevron design made up of multiple metallic layers which span the projectile rails. In a conventional electromagnetic launcher, such as illustrated in FIG. 6, projectile 62 is driven by the metallic armature 63 of the multi-chevron design. Current flow is as indicated by the arrows and it is believed and confirmed by computer calculations that a sharp current density is concentrated at the end layers closest to the current source. This current concentration results in higher resistance and greater current flow in a narrow layer through the armature 63. With the present invention, and as illustrated in FIG. 7, the armature 63 is moving in the direction from which current is being supplied, as indicated by the arrows and with such an arrangement it is believed that the current will distribute for more evenly across the metallic layers of the armature, resulting in less armature and rail deterioration.

For proper acceleration performance with the proposed reverse current fed electromagnetic launcher configurations, there must exist a high flux density region right in the wake of the projectile package. At high projectile velocities, rapid creation of this high flux density region right behind the projectile will be resisted, not only by eddy currents generated primarily in the just traversed projectile rails, but also in the feed rails. Since such eddy currents would reduce the accelerating force, certainly the projectile rails and probably also the feed rails should be constructed of thin and preferably transposed strands of wire.

Thus there has been provided an electromagnetic launcher system which substantially reduces or may even eliminate the likelihood of across-the-rail arcing in the wake of the projectile being driven by a plasma armature. The arrangement may be used as a single stage launcher or in multiple sequential stages and when so used for projectile launching, the wear on the projectile rails is expected to be substantially reduced. All of these factors contribute to improved performance, less maintenance and repeatability.

I claim:

1. Electromagnetic launcher apparatus, comprising:

(A) a pair of generally parallel, electrically conducting projectile rails having a breech end and a muzzle end;

(B) first and second electrically conducting feed rails each being positioned adjacent a respective one of said projectile rails and in substantial flux linking relationship therewith;

(C) said first and second feed rails being electrically connected to a respective one of said projectile rails at only the muzzle end thereof;

(D) an armature for conducting current between said projectile rails and for accelerating a projectile along said projectile rails from said breech end to said muzzle end; and (E) an energy source connected to said feed rails to supply a high current thereto.

2. Apparatus according to claim 1 wherein:

(A) said armature is a plasma started by the timely initiated voltage breakdown behind said projectile.

3. Apparatus according to claim 1 wherein:

(A) said feed rails have a self inductance per unit length of $L_{=F}$;

(B) said projectile rails have a self inductance per unit length of $L_{=P}$; and (C) $L_{=F} > L_{=P}$.

4. Apparatus according to claim 3 wherein:

(A) each one of said projectile rails partially surrounds a respective one of said feed rails.

5. Apparatus according to claim 3 wherein:

(A) each one of said projectile rails totally surrounds a respective one of said feed rails.

6. Apparatus according to claim 1 wherein:

(A) said feed rails have a length F;

(B) said projectile rails have a length P; and (C) $F > P$.

7. Apparatus according to claim 1 wherein:

(A) said energy source is a capacitor bank; and which includes (B) switch means connected in circuit between said capacitor bank and said feed rails.

8. Apparatus according to claim 7 which includes:

(A) an inductor connected in series with said capacitor bank for controlling the current supplied to said feed rails when said switch means is closed.

9. A method of electromagnetically launching a projectile located between projectile rails having a breech end and a muzzle end and having a driving armature bridging said rails, comprising the steps of:

(A) feeding a high current from an energy source to only the muzzle end of said rails; and (B) substantially eliminating any flux between said rails in front of said armature which might be caused by said high current fed to said rails.

10. A method of electromagnetically launching a projectile located in the bore between projectile rails having a breech end and a muzzle end, comprising the steps of:

(A) feeding a high current from an energy source by means of feed rails into only the muzzle end of said projectile rails; and (B) substantially accelerating said projectile by the accelerating force resulting from the interaction of the flux density between said rails produced in the wake of said projectile by current through said feed rails, with current flowing between said rails.

* * * * *